United States Patent [19]

Nilsson et al.

[11] 4,078,688

[45] Mar. 14, 1978

[54] CONTAINER CLOSURE

[75] Inventors: Ingvar Erling Nilsson, Akarp; Lars Harald Nystrom, Malmo, both of Sweden

[73] Assignee: Tetra Pak Developpement SA, Switzerland

[21] Appl. No.: 764,563

[22] Filed: Feb. 1, 1977

[30] Foreign Application Priority Data

Feb. 4, 1976 Sweden ..... 7601177

[51] Int. Cl.[2] ..... B65D 39/00

[52] U.S. Cl. ..... 215/270; 215/358; 215/DIG. 1

[58] Field of Search ..... 215/260, 270, 271, 358; 150/.5

[56] References Cited

U.S. PATENT DOCUMENTS

| | | | |
|---|---|---|---|
| 3,251,499 | 5/1966 | Rausing | 215/355 X |
| 3,317,070 | 5/1967 | Rausing | 215/254 X |
| 3,348,719 | 10/1967 | Rausing | 215/354 X |
| 3,415,405 | 12/1968 | Rausing | 215/270 X |

*Primary Examiner*—Donald F. Norton

*Attorney, Agent, or Firm*—Burns, Doane, Swecker & Mathis

[57] ABSTRACT

A container having a neck portion provided with an inwardly turned downwardly extending flange element is engaged with a cap device having a depending skirt portion which engages the flange element of the neck of the container so that when the container is filled with an aerated beverage or the like the pressure thereof is exerted against the cap device so as to enhance the sealing engagement of the cap device in the neck of the bottle.

6 Claims, 5 Drawing Figures

CONTAINER CLOSURE

The present invention relates to a container closure comprising a container opening with a neck projecting inwards and a cap device, closing the container opening, with a tubular part that can be inserted into the container opening, the tubular part as well as the container opening being shaped so that against the effect of an internal pressure in the container the cap device is retained in sealing engagement with the container opening.

Caps of the abovementioned type are manufactured of plastic material and are used e.g. in plastic bottles for beer and aerated refreshing drinks. The cap device comprises an annular recess arranged at its lower end for the mechanical retaining of the cap in the container opening, and a number of sealing elements arranged at a distance above the recess to form a seal in contact with the upper part of the inward-projecting neck or edge of the container. This type of cap has in its use up to now together with bottles of rigid and dimensionally relatively stable plastic material proved to comply satisfactorily with the demands made upon it, that is to say on the one hand that it should be able to withstand mechanical stresses during handling and stacking of the containers without the cap becoming loose or untight, and that the seal should be sufficiently good for the cap to prevent any leakage of the contents, whether in liquid or gaseous form, even on prolonged storage of the filled container and in the presence of an appreciable internal pressure in the container.

For various reasons it is desirable to manufacture certain types of packing containers or bottles from a plastic material which has the trade name Barex ® and which contains acrylonitrile, methyl acrylate and butadiene. The material has very good gas impermeability which substantially increases the keeping properties of the packed product compared with the types of plastics used previously for the purpose. The material is subject to a serious mechanical disadvantage, however, since on being subjected to stresses or tensions it displays cold flow or creep to a marked extent. This change in shape leads to a successively increased deformation of e.g. the package walls against which rest the sealing rings of the cap. Practical tests have shown, moreover, that packing containers of this type which have been closed with the type of cap described, commence to leak after a certain time of storage, although the packages were completely tight directly after filling and fitting of the cap.

It is an object of the present invention to provide a container closure which is specially suitable for use with a packing container made of a dimensionally not wholly stable material.

It is a further object of the present invention to provide a container closure which is not subject to the disadvantages of the aforementioned known container closures.

These and other objects have been achieved in accordance with the invention in that a container closure of the type described in the introduction has been given the characteristic that the inward-projecting neck of the container opening has an inner surface which is conically tapered downwards and which at the lower end of the neck cuts the lower end surface of the neck under an acute angle, whereby the annular line of intersection or edge formed is arranged so that it engages with a groove in the tubular part of the cap device, so that by resting against the lower boundary surface of the groove it retains the cap device in the container opening, whilst the inner surface of the neck, in an annular region situated a little above the edge, is arranged to provide a sealing closure for the container by resting against a lip-shaped sealing ring situated at the upper boundary surface of the groove.

Preferred embodiments of the container closure in accordance with the invention have been given the characteristics which are evident from the subsidiary claims.

By virtue of the special shape of the container closure in accordance with the invention, the compression forces deriving from the cap device, acting upon the packing container, will be concentrated on an annular portion at the lower end of the edge or neck projecting inwards. This is advantageous, since this portion is considerably less sensitive to the action than the upper part of the inward-projecting neck. Under the action of pressurized contents present in the packing container, which endeavour to press the cap device out of the annular neck portion, which is acted upon by the forces deriving from the sealing ring of the cap device, will, owing to the co-operation between the lower edge of the neck and the groove of the cap, be further stabilized and be prevented from expanding. The lip-shaped sealing ring situated at the upper boundary edge of the groove is relatively thin and yielding and will owing to the special insertion movement, determined by the shape of the container closure, after completed fitting of the cap, be folded downwards, as a result of which the pressure between lip-shaped sealing ring and the surface of the neck projecting inwards will increase because of the internal pressure in the container. Finally the co-operating shaping of the lower end of the inward-projecting neck and the lower boundary edge of the groove will retain the cap device in the container opening and further increase the sealing effect if the cap by internal or external forces tends to move upwards out of the container opening. This self-locking effect can be maximized without any disadvantage, since a lower part of the cap device, after fitting of the cap, is intended never to leave the container opening. Instead the container is opened by removing the upper part of the cap device along a weakening provided in the material.

The invention will be described in more detail in the following with reference to the enclosed drawing which shows schematically and on an enlarged scale cross-sections on the one hand through a known container closure and on the other hand through a container closure in accordance with the invention.

FIG. 1. shows a cap device of a known type before insertion into a container opening.

Figure 1:
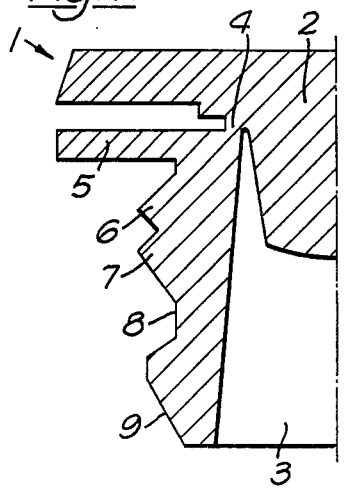
Figure 2:
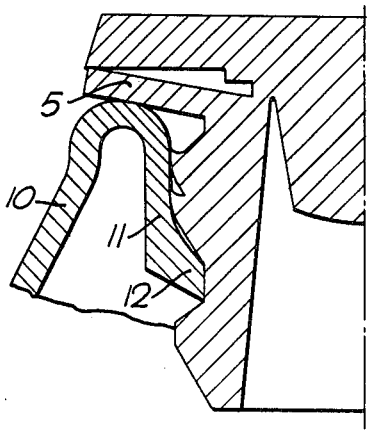
FIG. 2 shows the cap device in accordance with FIG. 1 after insertion into the container opening.

The container closure in accordance with the invention (FIGS. 3 and 4) has many similarities in shape as well as construction with the known device shown (FIGS. 1 and 2). The container closures thus both comprise a cap device 1 which is intended to be inserted into and to close a container opening. The cap device 1 comprises an upper part or a lid 2 and a lower, tubular part 3. The lid 2 which is connected via a breakable connection 4 in a liquid and gas tight manner to the tubular part 3 is provided on its periphery with a pull-handle not shown on the drawing.

The tubular part 3 is provided at its upper end with a flange 5 extending outwards which is arranged so that it limits the distance over which the cap device is to be inserted into the container opening. Directly below the flange 5 the tubular part of the cap is provided with sealing elements in the form of two sealing rings 6, 7 situated close to one another (FIGS. 1, 2). At some distance below the lower sealing ring 7, the tubular part 3 of the cap has an annular recess 8 which has a substantially trapezoidal cross-section. The tubular part 3 of the cap on its lower end has an entering surface 9 in the form of a truncated cone.

In FIG. 2 is shown a cap device in accordance with FIG. 1 in position in a container opening. Of the container only an upper part 10 is shown which is specially shaped so as to co-operate with the cap device and which comprises an edge or neck 11 folded inwards, at the lower end of which is arranged a flange 12 directed inwards which defines the neck opening. The flange 12 engages into the circumferential recess 8 in the tubular part 3 of the cap and prevents any moving of the cap device out of the container opening because of internal pressure or for some other reason. The figure also shows how the flange 5 arranged at the upper end of the tubular part 3 of the cap serves to limit the distance over which the cap device 1 is to be inserted into the container opening. The two sealing rings 6, 7, located between the flange 5 and the recess 8 are in sealing engagement with the surface of the folded-in part of the neck. Since the cap device 1 is made of a relatively soft plastic material, and since the sealing rings 6, 7 are relatively thin and resilient, they are bent upwards on insertion of the cap device into the container opening, as can be seen from the drawing.

As the container closure shown in FIGS. 1 and 2 is used for the closing of a packing container made of a material with a tendency to cold flow or creep, this means, as mentioned previously, that the container closure after a certain period of storage commences to leak. This has been found to depend on that force, which is required to make the sealing rings 6, 7 rest in a satisfactory manner against the surface of the folded-in part of the neck 11, is sufficiently great to produce an expansion of the container opening. More precisely, it will be especially the upper part of the neck 11 projecting inwards which will expand whilst the expansion at the lower part, where the flange 12 is situated, is appreciably less, which can be explained partly by the accumulation of material in the flange 12, partly by the stresses from the cap being greatest in the upper part, where the sealing rings 6, 7 are situated.

Figure 3:
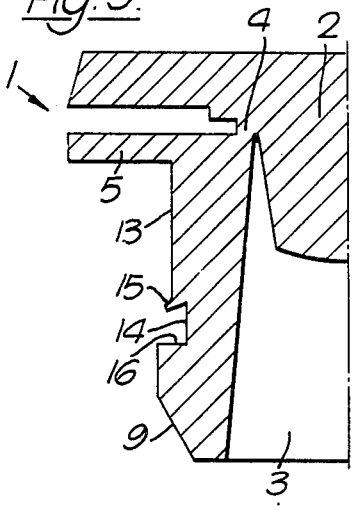
FIG. 3 shows a cap device in accordance with the invention before insertion into the container opening.
Figure 4:
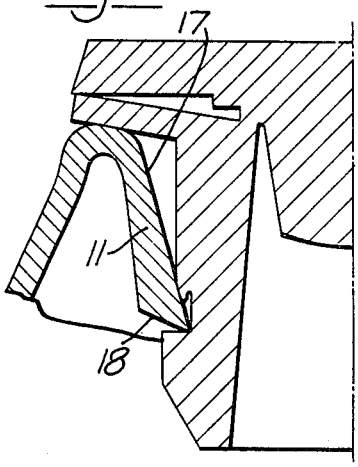
FIG. 4 shows the cap device in accordance with the invention in position in the container opening after fitting the cap onto the container.

The cap device in accordance with the invention is shown before insertion into the container opening in FIG. 3, and fitted in a container opening in FIG. 4. The cap device in accordance with the invention comprises like the known cap device an upper lid part 2, a lower tubular part 3 and an annular breakable connecting place 4. On the upper end of the tubular part 3 of the cap we find again the flange 5 which here too serves to fix the position of the cap device 1 in the container opening. Directly below the flange 5 the tubular part 3 of the cap has a relatively long cylindrical surface 13 at the lower end of which is arranged a circumferential groove 14. The lower end of the cap part 3 is terminated by the entering part 9.

Compared with the known cap device shown the cap device in accordance with the invention thus lacks the two sealing rings 6, 7. In the cap device in accordance with the invention the lower part situated at the groove 14 is instead given both a retaining and a sealing function. This has been achieved in that the groove 14 has been given a substantially dove-tailed cross-section with a sealing ring 15 of triangular cross-section arranged at the upper, outer boundary surface of the groove 14, and a lower boundary surface 16 which is comparatively strong and unyielding and is inclined slightly inwards towards the base of the groove 14. Moreover, the neck part 11 of the packing container has been given a somewhat different shape in that the flange has been eliminated. Instead the folded-in part of the neck has been given a material thickness which evenly increases towards the lower end and is shaped with a conical inner surface 17. The neck is terminated at its lower end by a conical end surface 18 which where it meets the inner surface 17 forms a comparatively sharp annular meeting line or edge.

It is evident from FIG. 4 how the container closure in accordance with the invention functions. The cap device 1 is in its position where it closes the container and the edge situated at the lower end of the inward-projecting neck 11 of the packing container is in engagement with the groove 14. The sealing ring 15 situated at the upper boundary area of the groove 14 rests against the surface of the inward-folded neck 11 directly above the annular edge and it should be observed that the resilient sealing ring 15 is folded down-wards. On insertion of the cap device 1 into the bottle neck, the cap device in the first place is pressed past the ultimate position. During this pressing down the sealing ring 15, owing to the shaping of the lower end of the cap, has no contact with the inward-projecting part 11 of the neck. When the cap device is pressed down to this lower position and the pressing down is discontinued, the cap device owing to its shaping springs back slightly upwards to its ultimate position. During this upwards movement the surface 17 of the inward-projecting neck 11 facing the container opening comes into contact with the sealing ring 15 and, owing to the friction between the same and the neck surface, the ring is turned downwards to the position shown in FIG. 4. The manner in which the cap device and the container opening co-operate during the fitting on of the cap will be described in more detail in the following.

When the cap device 1 is inserted into the container opening, the entering surface 9 will first come into contact with the upper edge portion of the inward-projecting neck 11. Since the cap device as well as the packing container are manufactured from material which is somewhat flexible, the entering surface 9 can during the continued pressing down of the cap device expand the container opening a little at the same time as the tubular part 3 of the cap is compressed. This makes it possible for the widest portion of the tubular part 3 of the cap to pass the part of the container opening which has the smallest diameter, i.e. the lower end of the neck part 11. During this part of the pressing down the tubular part of the cap is compressed and the inward-projecting part 11 of the neck is forced aside to such an extent that its inner surface 17 facing towards the container opening does not rest either against the cylindrical cap surface 13 or the sealing ring 15 situated at the lower end of the same. When the cap device 1 has been pressed in to the maximum extent, that is to say past its ultimate sealing position, any further insertion is prevented in that the flange 5, which during the final phase rests against the upper edge of the container opening, will come to be pressed against the lid part 2. In this maximum pressed-in position the outer edge of the lower boundary area 16 of the groove 14 has passed and is situated below the end surface 18 of the neck 11, which means that the lower end of the inward-projecting neck portion 11 can spring back to its original position. When this happens the tubular part of the cap also expands so that the edge between the surfaces 17 and 18 will rest against the base of the groove 14 and when the inserting tool (not shown) is withdrawn again the cap device, owing to the flexibility of the flange 5, resiliently springs back upwards until the lower surface 18 of the neck 11 rests against the surface 16. During this upward movement the sealing ring 15 rests against the surface 17 of the inward-projecting neck 11 facing towards the container opening and because of friction the sealing ring 15 is folded downwards to the position shown in FIG. 4.

It is evident from the above that in the course of the fitting of the cap, owing to its special shape, a movement is imparted to the cap which is such that the lip-shaped sealing ring 15 is given an optimum shape for preventing leakage from within the container. It should be noted that it is only the sealing ring 15 which is in sealing contact with the container opening. The pressure thus may pass between the annular edge of the neck and the groove 14 which is an advantage, since the pressure from within thereby increases the pressure against the lip seal and the sealing effect thereof. The special inwards-inclined shaping of the lower boundary surface 16 of the groove 14 and the shaping of the surface 18 bring about that an internal pressure in the container which endeavours to press the cap device out of the container opening will merely reduce the diameter at the lower end of the container opening and increase the contact force between the sealing ring 15 and the lower part of the inward-projecting neck 11, so that the problem mentioned earlier concerning the successive expansion of the neck diameter has been eliminated. Such an expansion can still be observed, it is true, at the upper end of the inward-projecting neck 11, but this expansion is of no importance, since sealing surfaces are not present in the upper part of the neck.

The positioning of the lip shaped sealing ring 15 directly at the edge of the inclined upper boundary area of the groove 14 is of great importance as it makes the sealing ring very yieldable so that the correct downwards folding of the sealing ring into the groove is ensured when the cap device is mounted in the container opening.

The lower edge surface 16 of the groove 14 is shaped appropriately with a slight incline inwards towards the base of the groove 14, which helps in ensuring the engagement of the neck end in the groove. However, even if the edge surface 16 is shaped without any incline inwards, the lower end of the neck 11 will be retained in the groove 14 because of the springiness inherent in the material and the incline of the lower surface 18.

Figure 5:
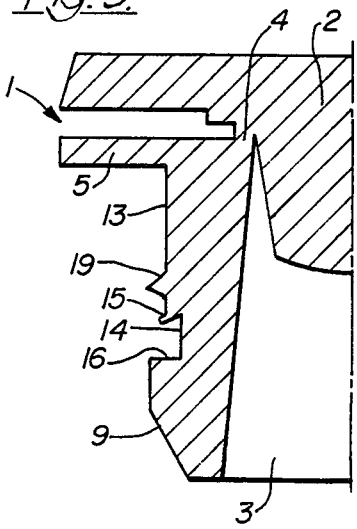
FIG. 5 shows a modified cap device similar to that shown in FIG. 3.

To prevent leakage in the event of any damage to the lower end of the neck surface 17, the cap device can be provided with a further sealing ring 19 which should then be arranged on the surface 13 in the direct vicinity or at a little distance above the sealing ring 15 as shown in FIG. 5.

We claim:

1. In combination with a container having an opening including an inwardly and downwardly projecting neck portion with a conical, downwardly tapered inner surface and a lower end surface intersecting the inner tapered surface at an acute angle to form an annular edge, a resilient cap device having a tubular depending portion for engaging said neck portion, said cap device having an annular groove with an upper and lower surface about the outer surface thereof and spaced intermediate the ends thereof, and an annular, lip-shaped sealing ring provided on the outer surface of the tubular portion, said sealing ring having a substantially triangular cross section and the lower surface of which is substantially coextensive with the upper surface of the groove, whereby when the cap device is inserted in the neck portion of the container, the annular edge of the neck portion will engage the lower surface of the groove in the cap device and the tapered inner surface of the neck portion will sealingly engage the sealing ring and bend it downwardly to form an annular seal between the cap device and the neck portion.

2. The combination as claimed in claim 1 wherein the median plane of the annular sealing ring is directed downwardly and outwardly from the tubular portion.

3. The combination as claimed in claim 1 wherein the groove in the cap device is dove-tailed.

4. The combination as claimed in claim 1 wherein that portion of the tubular portion below the annular groove has a greater diameter than the portion above the groove and is provided with a conical end portion for facilitating insertion of the cap device into the neck portion.

5. The combination as claimed in claim 1 wherein the lower surface of the annular groove is inclined inwardly and downwardly.

6. The combination as claimed in claim 1 wherein the tubular portion of the cap device is provided with a second annular sealing ring disposed above and adjacent the first mentioned sealing ring.

* * * * *